US006778141B1

(12) United States Patent
Yeh

(10) Patent No.: US 6,778,141 B1
(45) Date of Patent: Aug. 17, 2004

(54) PATCH ANTENNA WITH INCREASED BANDWIDTH

(75) Inventor: Ming-Hau Yeh, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 0 days.

(21) Appl. No.: 10/379,708

(22) Filed: Mar. 6, 2003

(51) Int. Cl.[7] ..... H01Q 1/38
(52) U.S. Cl. ..... 343/700 MS; 343/767
(58) Field of Search ..... 343/700 MS, 767, 343/846, 848, 702

(56) References Cited

U.S. PATENT DOCUMENTS 4,780,724 A * 10/1988 Sharma et al. ..... 343/700 MS
5,594,455 A * 1/1997 Hori et al. ..... 343/700 MS
5,872,542 A * 2/1999 Simons et al. ..... 343/700 MS
5,898,405 A * 4/1999 Iwasaki ..... 343/700 MS
6,218,990 B1 * 4/2001 Grangeat et al. .... 343/700 MS

* cited by examiner

*Primary Examiner*—Hoang V. Nguyen
(74) *Attorney, Agent, or Firm*—Bacon & Thomas PLLC

(57) ABSTRACT

The present invention is to provide a patch antenna including a patch and a ground plane printed on top and bottom surfaces of a dielectric substrate respectively, wherein the patch has a size smaller than that of the dielectric substrate and has a patch line extended from a center of a side of the patch to an edge of the dielectric substrate for serving as a signal wave feed line thereof, and a gap provided at one side of the patch line to separate the patch line from the patch for forming a circuitous current path from one edge of the patch line along the sides adjacent the gap to one side of the patch to significantly reduce inductance generated by signal wave and increase an effective bandwidth thereof.

4 Claims, 7 Drawing Sheets

PATCH ANTENNA WITH INCREASED BANDWIDTH

FIELD OF THE INVENTION

The present invention relates to patch antennas and more particularly to an improved patch antenna with increased bandwidth.

BACKGROUND OF THE INVENTION

As understood that an antenna is used in transmitting electromagnetic waves (i.e., signals) generated by an electronic device to the air or receiving signals by the electronic device. Hence, antennas have been widely provided in various electronic devices as ubiquitous elements. As such, a quality of transmitted or received signal strongly depends on performance of an antenna provided in the electronic device or whether an antenna characteristic is matched with the electronic device. Further, a high performance radio frequency (RF) circuit and digital circuit of an electronic device can be carried out only by incorporating a high quality antenna. In this regard, all electronic product designers and manufacturers pay a great attention to quality of antenna in the manufacturing process or even performance test of antenna in the finished electronic product.

Conventionally, antennas are classified based on their structures and characteristics as detailed below.

(1) Patch antenna: Referring to FIG. 1, a patch antenna 10 comprises a substrate 11 made of ceramic material. In detail, the substrate 11 is formed by heating a ceramic material, molding the melted ceramic material to produce a ceramic plate, and finally sintering the ceramic plate. A patch 12 and a ground plane 13 both of rectangle or square are printed on top and bottom surfaces of the substrate 11 by photolithography and etching respectively. Further, a feed pin 14 is pierced through the patch 12 and the ground plane 13 to connect to a signal wave feed line (e.g., coaxial cable) 15. As a result, a resonant cavity is formed between the patch 12 and the ground plane 13. A high frequency electromagnetic field is generated in the resonant cavity. The electromagnetic field is then radiated from a gap between the patch 12 and the ground plane 13. The patch antenna 10 is advantageous due to compactness, enhanced structural strength, high dielectric coefficient and low temperature coefficient of ceramic, good heat-resistant characteristic, low power loss, and applicable to various environments. A typical implementation of the patch antenna 10 is a ceramic patch antenna provided in a GSM (Global System for Mobile) based cellular phone. However, the patch antenna 10 also has a number of disadvantages. For example, a manufacturing process of the patch antenna 10 is complicated, resulting in a high manufacturing cost. Further, the signal wave feed line 15 such as coaxial cable has several drawbacks, e.g., time consuming in installation, the requisite provision of the additional feed pin 14, a welding of the feed pin 14 to the patch 12 and the substrate 11, and poor antenna quality caused by failed welding.

(2) Patch antenna having a patch line as feed line: Referring to FIG. 2, a patch antenna 20 comprises a substrate 21 formed on a circuit board. A patch 22 and a ground plane 23 both of rectangle or square are printed on top and bottom surfaces of the substrate 21 by photolithography and etching respectively. A patch line 24 is extended from a center of a side of the patch 22 to an edge of the substrate 21 so as to serve as a signal wave feed line. A gap 221 is formed at either side of the patch line 24 to separate the patch line 24 from the patch 22. As seen that a substantially W-shaped (i.e., circuitous) current path W indicated by dash line is formed along edges of the patch 22 and patch line 24 adjacent the gaps 221. Such arrangement can increase the current path W, resulting in a size reduction of the patch antenna 20. However, a very large inductance is generated by the circuitous current path W caused by forming the gaps 221 and the current path W passing two projections 222 each adjacent the gap 221. The strong inductance will adversely affect gain and bandwidth of the patch antenna 20, resulting in a prohibition of bandwidth increase.

(3) Patch antenna having a coplanar wave-guide as feed line: Referring to FIG. 3, a patch antenna 30 comprises a substrate 31 formed on a circuit board. A patch 32 and a ground plane 33 both of rectangle or square are printed on top and bottom surfaces of the substrate 31 by photolithography and etching respectively. A space 331 is formed in the ground plane 33. A patch line 34 is printed in the space 331. A signal wave feed line is coupled to the patch 32 from one end of the patch line 34 by means of a coplanar wave-guide. However, such antenna is undesirable due to complicated structure, design difficulty, tedious manufacturing process, and high cost.

Moreover, typically for increasing a bandwidth of patch antenna construction of the antenna is changed by patch antenna designers and manufacturers. As such, at least two resonant patterns are produced, resulting in an increased bandwidth in adjacent frequency bands. However, such is difficult to design. Further, thus produced antenna may be bulky due to practical considerations, thereby contradicting the trend of compactness. Hence, a need for improvement exists.

SUMMARY OF THE INVENTION

A primary object of the present invention is to provide a patch antenna with increased bandwidth. By utilizing this, the above drawbacks as experienced by patch antenna designers and manufacturers in attempting to increase the bandwidth of patch antenna can be overcome.

One object of the present invention is to provide a patch antenna including a patch and a ground plane printed on top and bottom surfaces of a dielectric substrate respectively by a technique the same as manufacturing a printed circuit board. The patch has a size smaller than that of the dielectric substrate. The antenna further comprises a patch line extended from a center of a side of the patch to an edge of the dielectric substrate for serving as a signal wave feed line of the patch antenna, and a gap provided at one side of the patch line to separate the patch line from the patch for forming a circuitous current path from one edge of the patch line along the sides adjacent the gap to one side of the patch. By the provision of the gap, the patch antenna can significantly reduce inductance generated by signal wave, increase an effective bandwidth, and significantly reduce design and manufacturing costs by means of a simple structure being easy to manufacture.

In one aspect of the present invention, the size and the shape of the gap between the one side of the patch line and the patch can be modified so as to obtain an improved signal matching.

The above and other objects, features and advantages of the present invention will become apparent from the following detailed description taken with the accompanying drawings.

DETAILED DESCRIPTION OF THE PREFERRED EMBODIMENTS

Figure 4:
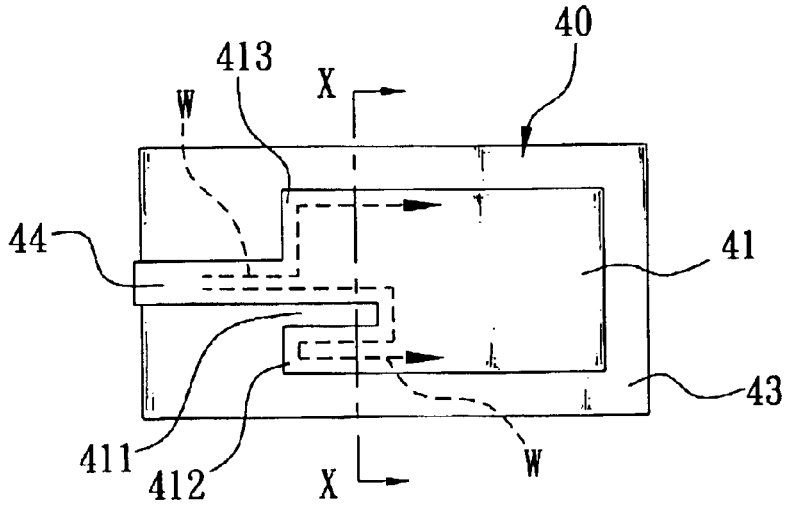
FIG. 4 is a top plan view of a first preferred embodiment of patch antenna according to the invention.
Figure 5:
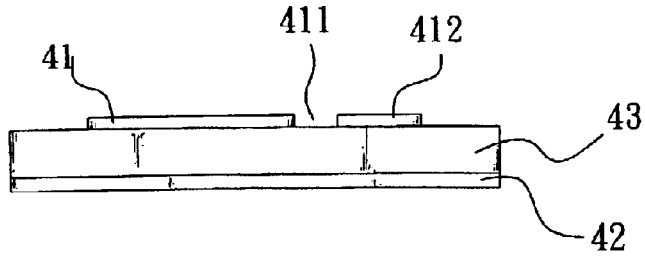
FIG. 5 is a cross-sectional view taken along line X—X of FIG. 4.

Referring to FIGS. 4 and 5, there is shown a patch antenna 40 in accordance with a first preferred embodiment of the invention. The patch antenna 40 comprises a patch 41 and a ground plane 42 printed on top and bottom surfaces of a dielectric substrate 43 respectively by a technique the same as manufacturing a printed circuit board. The patch 41 has a size smaller than the dielectric substrate 43. A patch line 44 is extended from a center of a side of the patch 41 to an edge of the dielectric substrate 43 so as to serve as a signal wave feed line of the patch antenna 40.

Referring to FIGS. 4 and 5 again, characteristics of the first preferred embodiment of the invention are detailed below. A gap 411 is formed by etching at one side of the patch line 44 to separate the patch line 44 from the patch 41. As seen that a circuitous current path W indicated by dash line is formed along one edge of the patch line 44 adjacent the side of the gap 411 to one side of the patch adjacent thereto. Such arrangement can not only increase the current path W but also reduce a size of the patch antenna 40. An inductance is generated by the circuitous current path W from one edge of the patch line 44 to a patch section 412 along the sides adjacent the gap 411. Further, no strong inductance is generated by current passing from another edge of the patch line 44 to another patch section 413. As a result, both gain and bandwidth of the patch antenna 40 are increased significantly.

The manufacturing process of the first preferred embodiment of the invention comprises forming the patch 41, the ground plane 42, the patch line 44, and the gap 411 on a circuit board. The manufacturing process is simple and easy. Further, the produced patch antenna 40 has a larger effective bandwidth. Moreover, it is permitted to adjust the shape and the size of the gap 411 depending on applications in manufacturing the patch antenna 40 according to the invention. As such, the current path W passing the patch section 412 and the gap 411 and the generated inductance can be controlled. As an end, both the gain and the bandwidth of the patch antenna 40 can be increased for complying with the product specifications.

Figure 6:
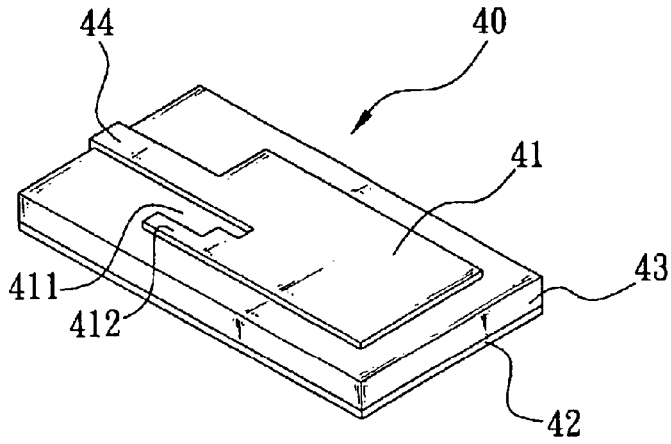
FIG. 6 is a perspective view of a second preferred embodiment of patch antenna according to the invention.

Referring to FIG. 6, there is shown a second preferred embodiment of the invention. The differences between the first and the second preferred embodiments, i.e., the characteristics of the second preferred embodiment are detailed below. The gap 411 at one side of the patch line 44 can be formed as an enlarged one toward its opening depending on requirements of the gain and the bandwidth of the patch antenna 40. Hence, a circuitous current path W from one edge of the patch line 44 to the patch section 412 along the sides adjacent the gap 411 can be further away from the current path passed the patch line 44. This can significantly decrease an undesired inductance effect on the signal. As a result, the gain of the patch antenna 40 is increased significantly and a good signal matching is obtained.

Figure 7:
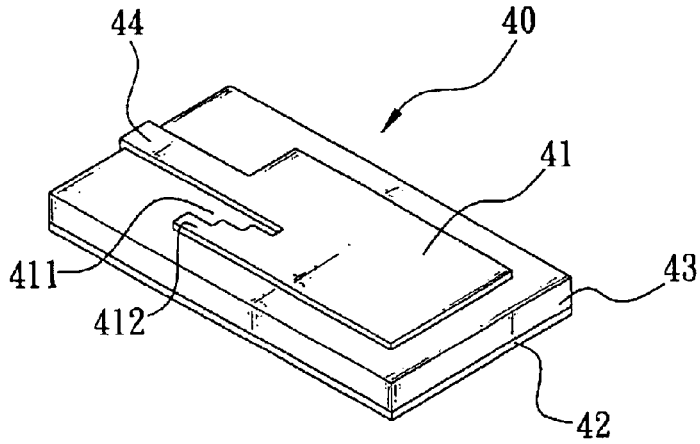
FIG. 7 is a perspective view of a third preferred embodiment of patch antenna according to the invention.

Referring to FIGS. 4, 6, and 7, there are shown three patch antennas 40 of the same size manufactured according to the first, second, and third preferred embodiments of the invention respectively. As seen, they have a common characteristic, i.e., the gap 411 is formed at one side of the patch line 44. The differences are that the gap 411 of the patch antenna 40 is an elongated one as shown in FIG. 4 (i.e., the first preferred embodiment), the gap 411 of the patch antenna 40 is an opening spread outward with a two-stage section as shown in FIG. 6 (i.e., the second preferred embodiment), and the gap 411 of the patch antenna 40 is an opening spread outward with a three-stage section as shown in FIG. 7 (i.e., the third preferred embodiment).

Figure 1:
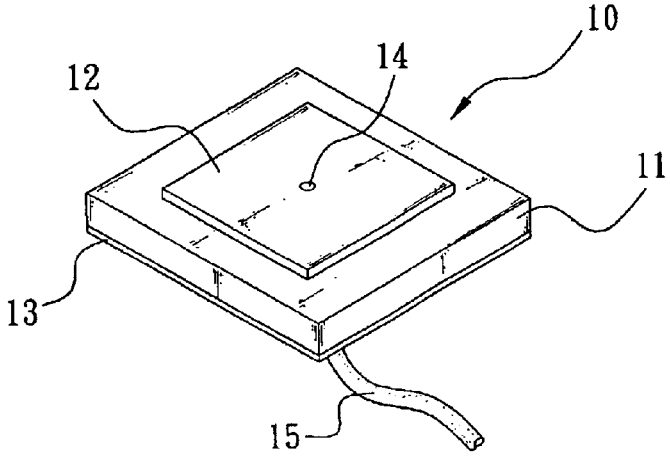
FIG. 1 (Prior Art)
FIG. 1 is a perspective view of a conventional patch antenna.
Figure 2:
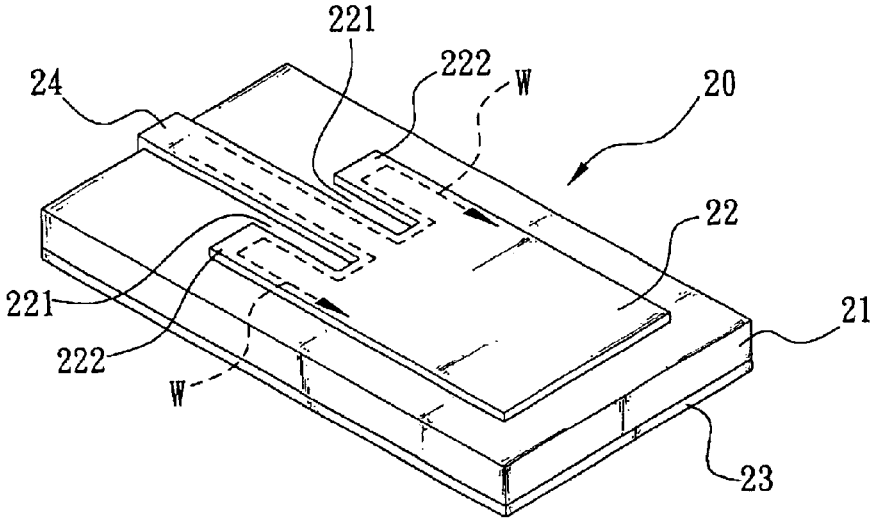
FIG. 2 (Prior Art)
FIG. 2 is a perspective view of another conventional patch antenna having a patch line as feed line.
Figure 3:
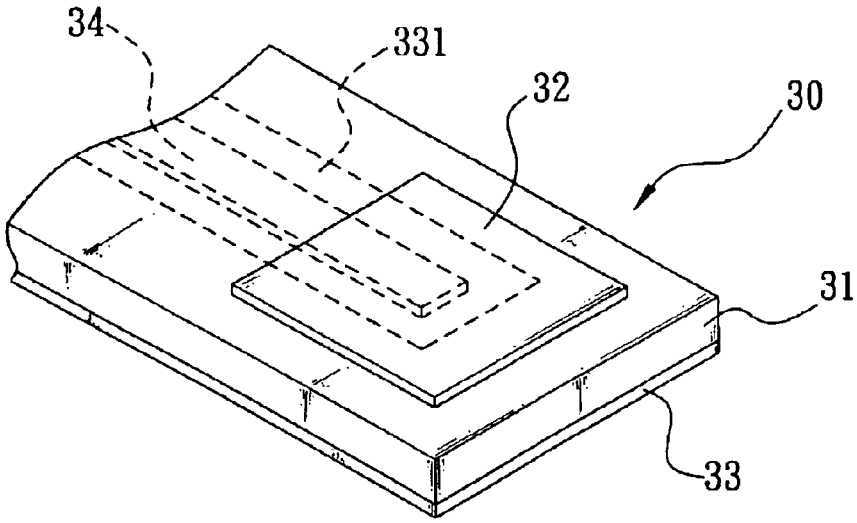
FIG. 3 (Prior Art)
FIG. 3 is a perspective view of a further conventional patch antenna having a coplanar wave-guide as feed line.
Figure 8:
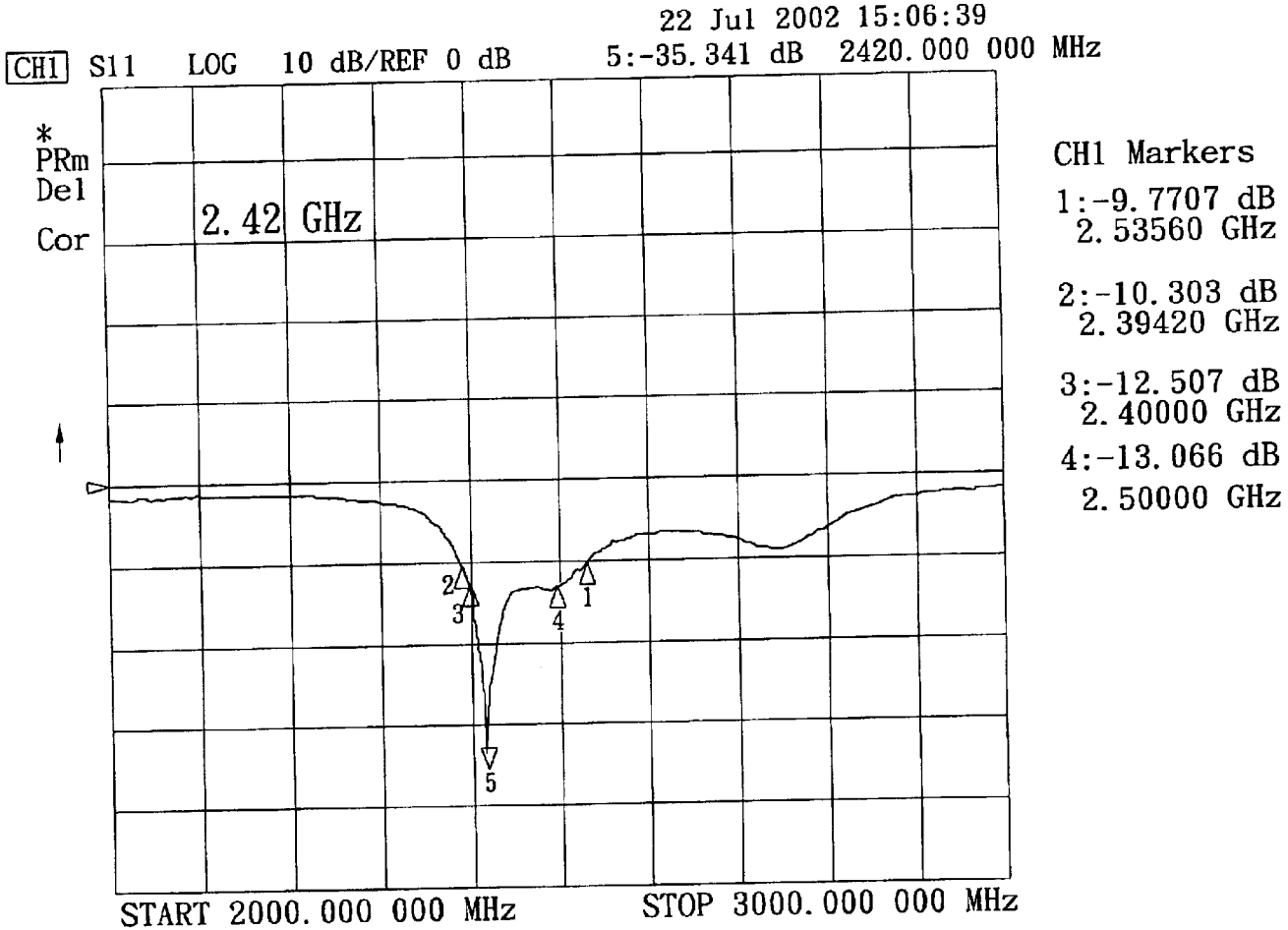
FIG. 8 is a graph showing test result obtained by the patch antenna of FIG. 4.
Figure 9:
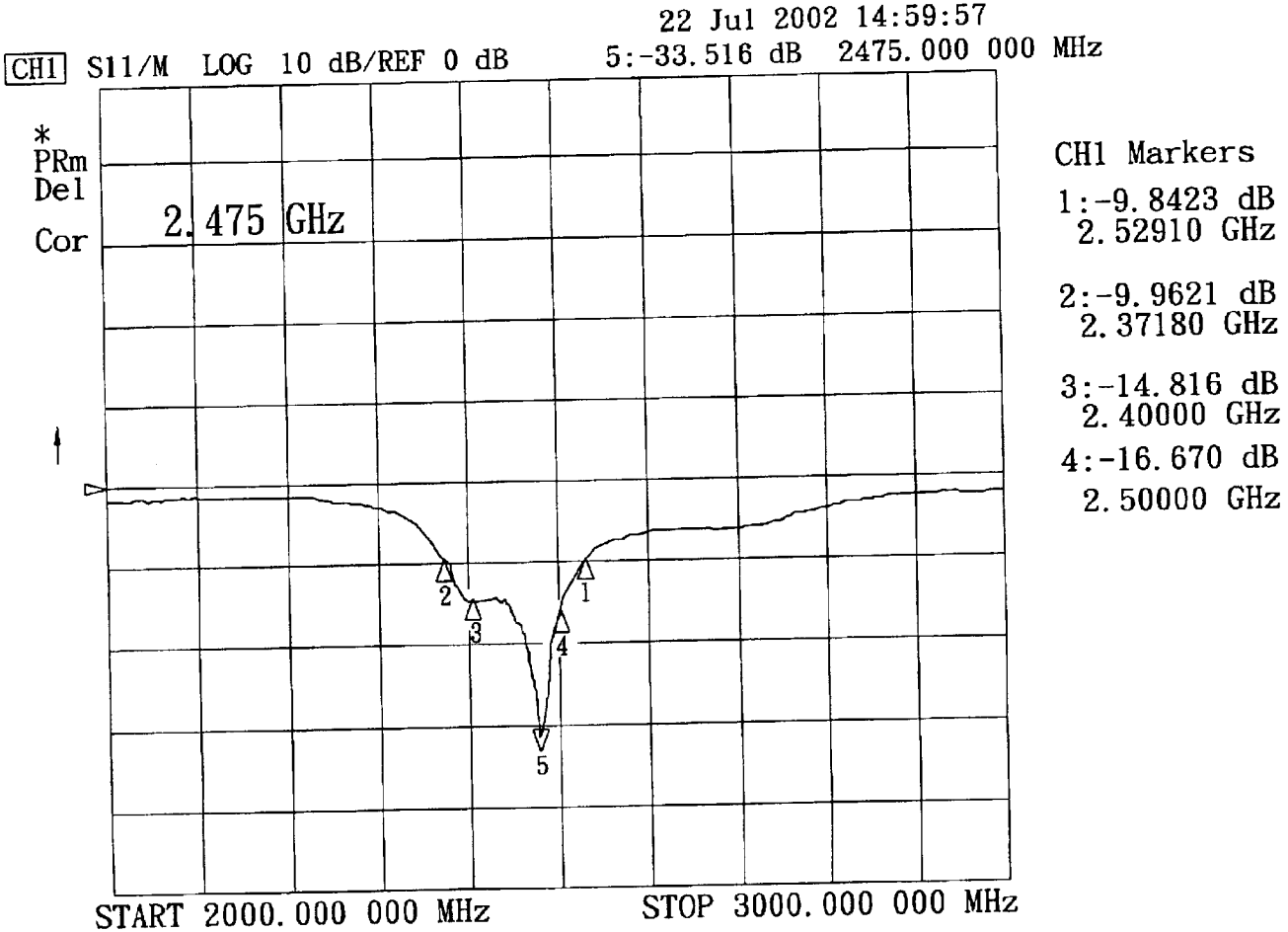
FIG. 9 is a graph showing test result obtained by the patch antenna of FIG. 6.
Figure 10:
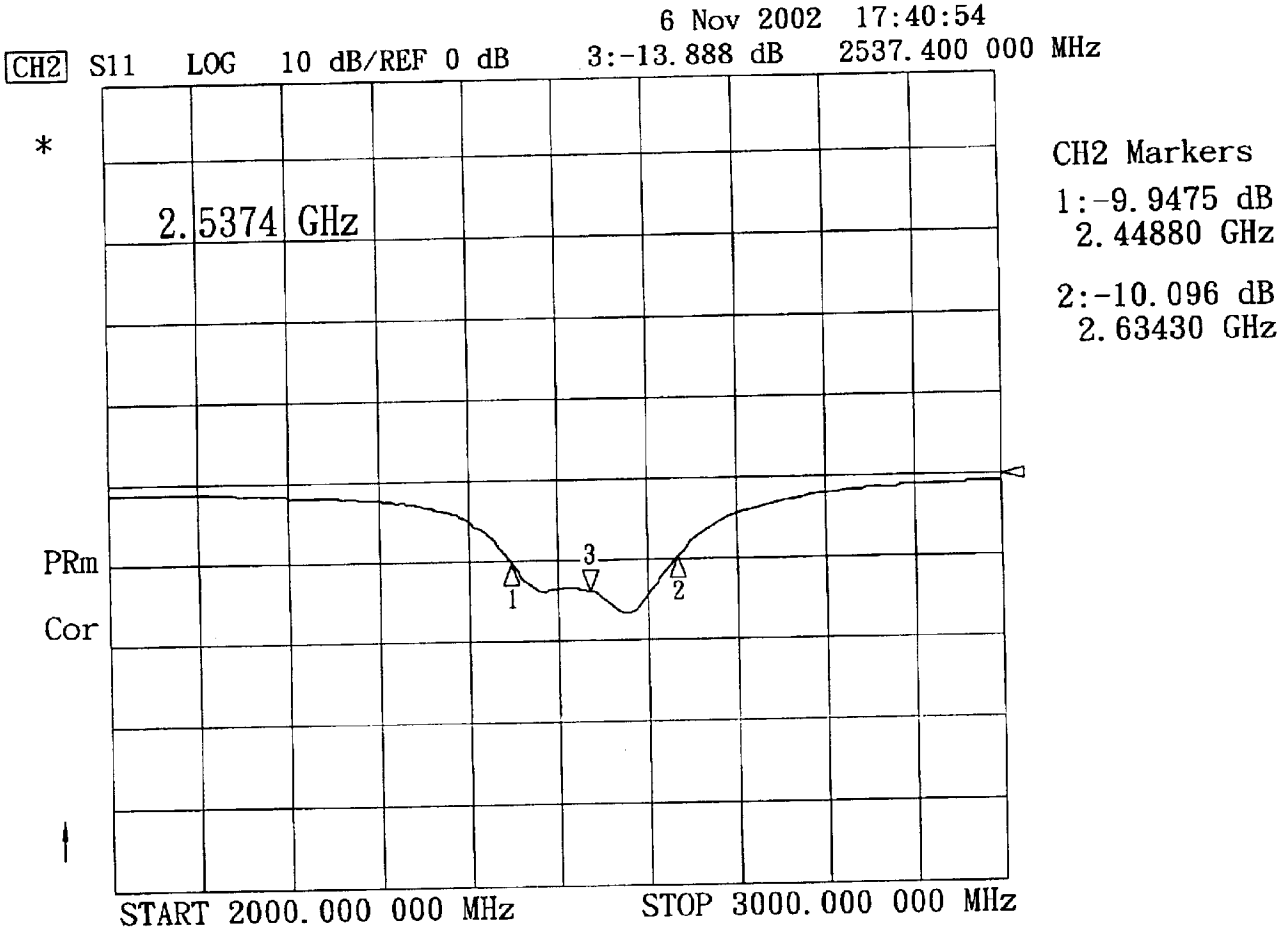
FIG. 10 is a graph showing test result obtained by the patch antenna of FIG. 7.
Figure 11:
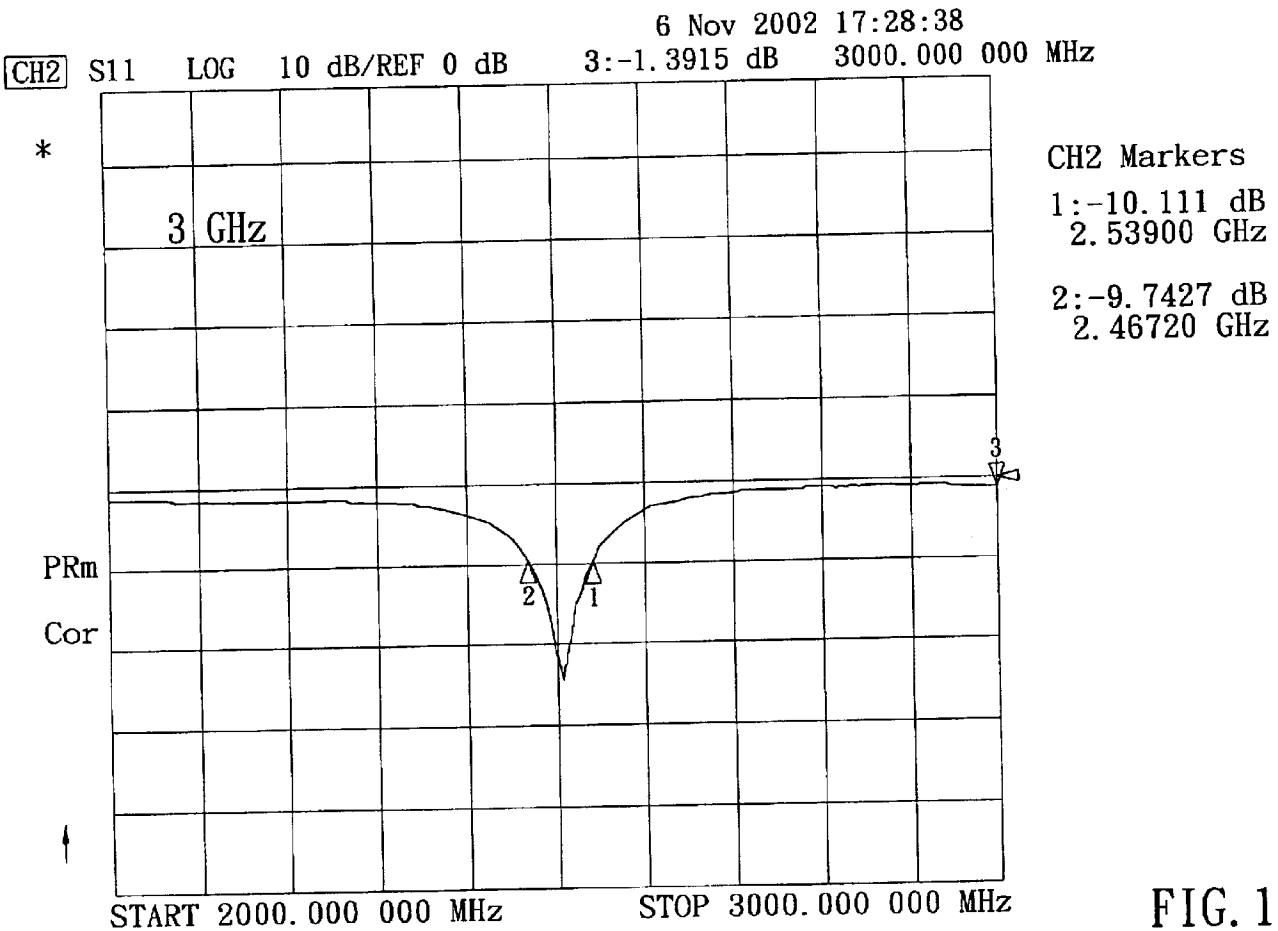
FIG. 11 (Prior Art)
FIG. 11 is a graph showing test result obtained by the well-known patch antenna of FIG. 2 taken as comparison with that obtained by the embodiments of the invention.

Referring to FIGS. 8, 9, and 10, there are shown test results obtained by using a frequency and impedance measurement device to test the patch antennas of the first, second, and third embodiments respectively. As to FIG. 11, it shows a test result obtained by using the same frequency and impedance measurement device to test the prior art patch antenna shown in FIG. 2. By comparison, it is found that at a distance between $\Delta 1$ and $\Delta 2$ (i.e., taken −10 dB as a comparison reference) the patch antenna 40 of the invention has a bandwidth larger than that of the prior art patch antenna. As an end, a good signal matching is obtained by the invention.

In brief, the invention can significantly increase the bandwidth of the patch antenna 40. Hence, the patch antenna 40 produced by mass production has an effective bandwidth capable of complying with the frequency band specifications of the electronic product. As a result, a specification tolerance is increased in mass production. Additionally, it is possible of effectively controlling a direction of signal transmitted from antenna, significantly reducing an adverse effect of signal being transmitted from antenna on an electronic product, increasing an antenna gain of the patch antenna 40 of the invention as compared with the prior art omni directional antenna, and increasing signal transmission and receiving distances by modifying the size and the shape of the gap 411 (i.e., forming an opening spread outward with a two-stage or three-stage section).

While the invention has been described by means of specific embodiments, numerous modifications and variations could be made thereto by those skilled in the art without departing from the scope and spirit of the invention set forth in the claims.

What is claimed is:

1. A patch antenna with an increased bandwidth comprising:

a dielectric substrate;

a ground plane provided on one side of the dielectric substrate;

a patch provided on the other side of the dielectric substrate, the patch having a size smaller than that of the dielectric substrate;

a patch line extended from a center of a side of the patch to an edge of the dielectric substrate for serving as a signal wave feed line of the patch antenna; and a gap provided at one side of the patch line to separate the patch line from the patch for forming a circuitous current path from one edge of the patch line along the sides adjacent the gap to one side of the patch.

2. The patch antenna of claim 1, wherein the gap at one side of the patch line is spread outward toward its opening so as to form another circuitous current path from one edge of the patch line along the sides adjacent the gap to one side of the patch having the current path away from the current path on the patch line.

3. The patch antenna of claim 2, wherein the spread outward opening is a staged opening.

4. The patch antenna of claim 2, wherein the spread outward opening is a curve opening.

* * * * *